US007406837B2

(12) United States Patent
Nemoto et al.

(10) Patent No.: US 7,406,837 B2
(45) Date of Patent: Aug. 5, 2008

(54) AMMONIA/$CO_2$ REFRIGERATION SYSTEM

(75) Inventors: Takashi Nemoto, Kashiwa (JP); Akira Taniyama, Kashiwa (JP); Shinjirou Akaboshi, Tsukuba (JP); Iwao Terashima, Moriya (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

(21) Appl. No.: 11/692,291

(22) Filed: Mar. 28, 2007

(65) Prior Publication Data

US 2007/0234753 A1 Oct. 11, 2007

Related U.S. Application Data

(63) Continuation of application No. PCT/JP2005/012232, filed on Jul. 1, 2005.

(30) Foreign Application Priority Data

Sep. 30, 2004 (JP) ..... 2004-289105

(51) Int. Cl.
*F25B 25/00* (2006.01)

(52) U.S. Cl. ..... 62/332; 62/512; 62/435

(58) Field of Classification Search ..... 62/332–333, 62/509, 512, 430–439
See application file for complete search history.

(56) References Cited

U.S. PATENT DOCUMENTS 4,130,997 A 12/1978 Hara et al.

(Continued)

FOREIGN PATENT DOCUMENTS

JP 52-70473 A 6/1977

(Continued)

OTHER PUBLICATIONS

Relevant portion of the International Search Report issued in corresponding PCT application PCT/JP05/12232 with a mailing date of Oct. 11, 2005.

*Primary Examiner*—William E Tapolcai
(74) *Attorney, Agent, or Firm*—Rossi, Kimms & McDowell LLP

(57) ABSTRACT

An ammonia/$CO_2$ refrigerating system having a liquid pump for feeding the liquid $CO_2$ cooled in a brine cooler by the utilization of the vaporization latent heat of ammonia in an ammonia refrigeration cycle to a cooler, which comprises a liquid receiving vessel 4 for receiving a $CO_2$ brine cooled in a brine cooler 3, a liquid pump 5 capable of changing the rate of the feed of a liquid, a rising piping 90 provided between the liquid pump 5 and a cooler 6, and a communication pipe 100 for communicating the top of the riser pipe 90 with the $CO_2$ gas phase in the liquid receiving vessel 4, wherein the discharge pressure of the liquid pump 5 is set so as for the $CO_2$ recovered form the cooler 3 or the liquid receiver 4 in the state of a liquid or a gas-liquid mixture, and the level of the rise in the rising piping 90 is set at a level being the same as or higher than the highest storage level for the $CO_2$ brine in the liquid receiving vessel 4. The above ammonia/$CO_2$ refrigerating system allows a refrigeration cycle of a combination of an ammonia cycle and a $CO_2$ cycle to be formed with no care, even when a refrigerating showcase, which is the cooler side of the $CO_2$ cycle, is installed at an arbitrary place.

8 Claims, 11 Drawing Sheets

U.S. PATENT DOCUMENTS

| | | | | | |
|---|---|---|---|---|---|
| 5,442,931 | A * | 8/1995 | Ryan et al. | ..... | 62/101 |
| 6,000,233 | A * | 12/1999 | Nishida et al. | ..... | 62/114 |
| 6,112,532 | A | 9/2000 | Bakken | | |
| 6,349,558 | B1 * | 2/2002 | Ichikawa et al. | ..... | 62/434 |
| 6,619,066 | B1 | 9/2003 | Kaneo | | |
| 6,966,196 | B2 * | 11/2005 | Matsuki et al. | ..... | 62/305 |

FOREIGN PATENT DOCUMENTS

| | | | |
|---|---|---|---|
| JP | 4-76393 | A | 3/1992 |
| JP | 2001-507784 | A | 6/2001 |
| JP | 2003-166765 | A | 6/2003 |
| JP | 3458310 | B2 | 8/2003 |

* cited by examiner

AMMONIA/$CO_2$ REFRIGERATION SYSTEM

CROSS REFERENCE TO RELATED APPLICATION

This is a continuation of International Application PCT/JP2005/012232 (published as WO 2006/038354) having an international filing date of 01 Jul. 2005, the contents of which is incorporated by reference herein.

TECHNICAL FIELD

The present invention relates to a refrigeration system working on an ammonia refrigerating cycle and $CO_2$ refrigerating cycle, specifically relates to an ammonia refrigerating cycle, a brine cooler for cooling and liquefying $CO_2$ by utilizing the latent heat of vaporization of ammonia, and an ammonia/$CO_2$ refrigeration system having a liquid pump in a supply line for supplying to a refrigeration load side the liquefied $CO_2$ cooled and liquefied by said brine cooler.

BACKGROUND ART

Amid strong demand for preventing ozone layer destruction and global warming in these days, it is imperative also in the field of air conditioning and refrigeration not only to draw back from using CFCs from the viewpoint of preventing ozone layer destruction, but also to recover alternative compounds HFCs and to improve energy efficiency from the viewpoint of preventing global warming. To meet the demand, utilization of natural refrigerant such as ammonia, hydrocarbon, air, carbon dioxide, etc. is being considered, and ammonia is being used in many of large cooling/refrigerating equipment. Adoption of natural refrigerant tends to increase also in cooling/refrigerating equipment of small scale such as a refrigerating storehouse, goods disposing room, and processing room, which are associated with said large cooling/refrigerating equipment.

However, as ammonia is toxic, a refrigerating cycle, in which an ammonia cycle and $CO_2$ cycle are combined and $CO_2$ is uses as a secondary refrigerant in a refrigeration load side, is adopted in many of ice-making factories, refrigerating storehouses, and food refrigerating factories.

A refrigeration system in which ammonia cycle and carbon dioxide cycle are combined is disclosed in Patent Literature 1 for example. The system is composed as shown in FIG. 11(A). In the drawing, first, in the ammonia cycle gaseous ammonia compressed by the compressor 104 is cooled by cooling water or air to be liquefied when the ammonia gas passes through the condenser 105. The liquefied ammonia is expanded at the expansion valve 106, then evaporates in the cascade condenser 107 to be gasified. When evaporating, the ammonia receives heat from the carbon dioxide in the carbon dioxide cycle to liquefy the carbon dioxide.

On the other hand, in the carbon dioxide cycle, the carbon dioxide cooled and liquefied in the cascade condenser 107 flows downward by its hydraulic head to pass through the flow adjusting valve 108 and enters the bottom feed type evaporator 109 to perform required cooling. The carbon dioxide heated and evaporated in the evaporator 109 returns again to the cascade condenser 107, thus the ammonia performs natural circulation.

In the system of said prior art, the cascade condenser 107 is located at a position higher than that of the evaporator 109, for example, located on a rooftop. By this, hydraulic head is produced between the cascade condenser 107 and the evaporator 109 having a cooler fan 109*a*.

The principle of this is explained with reference to FIG. 1(B) which is a pressure-enthalpy diagram. In the drawing, the broken line shows an ammonia refrigerating cycle using a compressor, and the solid line shows a $CO_2$ cycle by natural circulation which is possible by composing such that there is a hydraulic head between the cascade condenser 107 and the bottom feed type evaporator 109.

However, said prior art includes a fundamental disadvantage that the cascade condenser (which works as an evaporator in the ammonia cycle to cool carbon dioxide) must be located at a position higher than the position of the evaporator (refrigerating showcase, etc.) for performing required cooling in the $CO_2$ cycle.

Particularly, there may be a case that refrigerating showcases or freezer units are required to be installed at higher floors of high or middle-rise buildings at customers' convenience, and the system of the prior art absolutely can not cope with the case like this.

To deal with this, some of the system provide a liquid pump 110 as shown in FIG. 11(B) in the carbon dioxide cycle to subserve the circulation of the carbon dioxide refrigerant to ensure more positive circulation. However, the liquid pump serves only as an auxiliary means and basically natural circulation for cooling carbon dioxide is generated by the hydraulic head also in this prior art.

That is, in the prior art, a pathway provided with the auxiliary pump is added parallel to the natural circulation route on condition that the natural circulation of $CO_2$ is produced by the utilization of the hydraulic head. (Therefore, the pathway provided with the auxiliary pump should be parallel to the natural circulation route.)

Particularly, the prior art of FIG. 11(B) utilizes the liquid pump on condition that the hydraulic head is secured, that is, on condition that the cascade condenser (an evaporator for cooling carbon dioxide refrigerant) is located at a position higher than the position of the evaporator for performing cooling in the carbon dioxide cycle, and above-mentioned fundamental disadvantage is not solved also in this prior art.

In addition, it is difficult to apply this prior art when evaporators (refrigerating showcases, cooling apparatuses, etc.) are to be located on the ground floor and the first floor and accordingly the hydraulic head between the cascade condenser and each of the evaporator will be different to each other.

In the prior arts, there is a restriction for providing a hydraulic head between the cascade condenser 107 and the evaporator 109 that natural circulation does not occur unless the evaporator is of a bottom feed type which means that the inlet of $CO_2$ is located at the bottom of the evaporator and the outlet of $CO_2$ is provided at the top thereof as shown in FIG. 11(A) and FIG. 11(B).

However, in the bottom feed type condenser, liquid $CO_2$ enters the cooling tube from the lower side evaporates in the cooling tube and flows upward while receiving heat, i.e. depriving heat of the air outside the cooling tube, and the evaporated gas flows upward in the cooling tube. So, in the cooling tube, the upper part is filled only with gaseous $CO_2$ resulting in poor cooling effect and only lower part of the cooling tube is effectively cooled. Further, when a liquid header is provided at the inlet side, uniform distribution of $CO_2$ in the cooling tube can not be realized. Actually, as can be seen in pressure-enthalpy diagram of FIG. 1(B), $CO_2$ is recovered to the cascade condenser after liquid is $CO_2$ perfectly evaporated.

Further, a refrigerating cycle using $CO_2$ as a secondary refrigerant for refrigerating load side is adopted very often in ice works, refrigeration warehouses, and freezing works of food. In these refrigerating apparatuses, it is required to stop the operation of apparatus and to carry out defrosting and cleaning of the cooler (evaporator) at regular intervals or as needed from point of view of maintaining refrigerating capacity, sterilization, etc. When these work operation are carried out, temperature rise occurs naturally in the cooler (evaporator). So, if liquid $CO_2$ remains in the circulation path near the cooler (evaporator), there is fear that explosive vaporization (boiling) of liquid $CO_2$ could occur. Therefore, it is desired to withdraw the liquid $CO_2$ remaining near the cooler (evaporator) without delay and completely.

[Patent Literature 1] Japanese Patent No. 3458310

DISCLOSURE OF INVENTION

Problems to be Solved by the Invention

The present invention was made in light of the problem mentioned above, and an object of the invention is to provide an ammonia/$CO_2$ refrigeration system and a $CO_2$ brine producing apparatus used in the system capable of constituting a cycle combining an ammonia cycle and a $CO_2$ cycle without problems even when the $CO_2$ brine producing apparatus comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side, and a refrigeration load side apparatus such as for example a freezer showcase are located in any places in accordance with circumstances of customer's convenience.

Another object of the invention is to provide a refrigeration system in which $CO_2$ circulation cycle can be formed irrespective of the position of the $CO_2$ cycle side cooler, kind thereof (bottom feed type of top feed type), and the number thereof, and further even when the $CO_2$ brine cooler is located at a position lower than the refrigeration load side cooler, and a $CO_2$ brine producing apparatus used in the system.

A further object of the invention is to provide a refrigeration system in which withdrawal of liquid $CO_2$ from the $CO_2$ cycle is carried out without delay and completely when carrying out defrosting and cleaning of the cooler of $CO_2$ cycle side.

MEANS TO SOLVE THE PROBLEM

The present invention proposes an ammonia/$CO_2$ refrigeration system comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side heat exchanger (cooler), wherein are provided;

a receiver for receiving $CO_2$ brine cooled in said brine cooler, a liquid pump composed to be a variable-discharge type forced circulating pump, which corresponds to said liquid pump for supplying the cooled and liquefied $CO_2$, a riser pipe located between said liquid pump and a heat exchanger of refrigeration load side, a communication pipe for connecting the top part of the riser pipe to the $CO_2$ gas layer in said liquid receiver;

wherein discharge pressure (of forced circulation) is determined so that $CO_2$ recovered from the outlet of cooler of refrigeration load side returns to said brine cooler or said liquid receiver in a liquid or gas/liquid mixed state (incompletely evaporated state), and wherein the top part of the riser pipe runs along a height position equal to or higher than the maximum liquid level of $CO_2$ reserved in the liquid receiver.

In this case, the volume of the liquid receiver including the volume in the pipe connecting to the inlet of the liquid pump is determined so that there remains a room for $CO_2$ gas above liquid $CO_2$ recovered to the liquid receiver when the operation of $CO_2$ brine cycle is halted, with the level of the top part of the riser pipe determined to be higher than the maximum liquid level in the liquid receiver.

In the present invention, actual head for the liquid pump is the height from the inlet of the pump to the top part of the riser pipe, and it is preferable to determine the top part of the riser pipe is at a level equal to or lower than that of the top part of the return pipe.

To be more specific, it is suitable that a pressure sensor is provided for detecting pressure difference between the outlet and inlet of the liquid pump, and the liquid pump is composed so that it can achieve discharge head equal to or higher than the sum of actual head from the liquid pump to the top part of the riser pipe and loss of head in the piping.

Further, it is suitable that a supercooler is provided for supercooling at least a part of the liquid $CO_2$ in the liquid receiver in order to maintain liquid $CO_2$ in a supercooled state at the inlet of the liquid pump. By this, enough suction pressure can be secured to prevent the occurrence of cavitation at the inlet of the liquid pump.

Concretively, it is suitable that the liquid receiver for reserving liquid $CO_2$ supercooled at any rate is located at a position higher than the suction side of the liquid pump.

Further, it may be suitable that a pressure sensor and a temperature sensor for detecting the pressure and temperature of $CO_2$ in the liquid receiver, a controller for determining the degree of supercooling by comparing the saturation temperature of $CO_2$ at the detected pressure with the detected temperature are further provided, and flow of ammonia introduced to the supercooler is controlled by a signal from said controller.

It is also suitable that the top part of the riser pipe is connected to the $CO_2$ gas layer in the liquid receiver with the communication pipe so that a part of $CO_2$ brine is returned to the liquid receiver when the liquid pump is operating, $CO_2$ gas is introduced to the top part of the riser pipe from the $CO_2$ gas layer in the liquid receiver, and a flow control valve is provided to the communication pipe.

Further, it is suitable to compose such that the brine cooler is located at a height position higher than that of the liquid receiver, $CO_2$ of liquid state or gas-liquid mixed state recovered from the outlet of the refrigeration load side cooler is returned to the $CO_2$ layer in the liquid receiver, the $CO_2$ layer in the liquid receiver is communicated to the brine cooler via a piping so that $CO_2$ brine condensed and liquefied in the brine cooler is returned to the liquid receiver to be stored therein.

EFFECT OF THE INVENTION

The discharge flow rate and discharge head of the liquid pump 5 is determined so that $CO_2$ recovered from the outlet of the cooler of the refrigeration load side to the brine cooler 3 in a liquid or liquid/gas mixed state (incompletely evaporated state). Hereunder, the effect of providing the liquid pump 5 will be explained with reference to FIG. 6(*a*).

As is described in the foregoing, the liquid pump is a variable discharge pump to perform forced circulation of $CO_2$ to recover $CO_2$ from the outlet of the cooler of the refrigeration load side to the brine cooler 3 in a liquid or liquid/gas mixed state (imperfectly evaporated state). So, the pump 5 is designed to discharge larger than 2 times, preferably 3~4 times the circulation flow required by the cooler of the refrigeration load side at a discharge head of equal to or higher than the sum of actual head and loss of head in the piping. Therefore, $CO_2$ can be circulated smoothly in the $CO_2$ cycle even if the $CO_2$ brine cooler 3 in the ammonia cycle is located in the basement of a building and the cooler capable of allowing evaporation in a liquid or liquid/gas mixed state (imperfectly evaporated state) such as a showcase, etc. is located at an arbitrary position above ground. Accordingly, the $CO_2$ cycle can be operated, when coolers (refrigerating showcases, room coolers, etc) are installed on the ground floor and first floor of a building, irrelevantly to the hydraulic head between each of the coolers and the $CO_2$ brine cooler 3.

As the system is composed so that $CO_2$ is recovered to the brine cooler 3 from the outlet of the heat exchanger (cooler) of the refrigeration load side in a liquid or liquid/gas mixed state through the return pipe, $CO_2$ is maintained in a liquid/gas mixed state even in the upper parts of cooling tube of the cooler even when the cooler is of a top feed type. Therefore, there does not occur a situation that the upper part of the cooling tube is filled only with gaseous $CO_2$ resulting in insufficient cooling, so the cooling in the coolers is performed all over the cooling tube effectively.

$CO_2$ cycle can be performed smoothly similarly as describe above even in the case the brine cooler 3 and the cooler 6 (refrigeraring show case, etc.) having function of evaporating $CO_2$ in a liquid or gas/liquid mixed state are located in the same stairs in the ammonia cycle, or the brine cooler is located in upstairs and the cooler 6 (refrigeraring show case, etc.) having function of evaporating $CO_2$ in a liquid or gas/liquid mixed state $CO_2$ cycle is located in downstairs in the ammonia cycle.

Next, the reason of providing the riser pipe 90 between the liquid pump 5 and the refrigeration load side heat exchanger (cooler 6), allowing the top part of the riser pipe 90 to run along a height position equal to or higher than the maximum liquid level of $CO_2$ in the liquid receiver 4, and connecting the top part of the riser pipe to the gas layer in the liquid receiver with the communication pipe will be detailed.

The $CO_2$ brine cycle of the system of the invention is composed so that $CO_2$ is returned to the brine cooler 3 from the outlet of the cooler of the refrigeration load side in a liquid or liquid/gas mixed state (incompletely evaporated state), so the $CO_2$ brine circulate in the cycle substantially in a saturated liquid state unlike the prior art of natural circulation type. The volume of the liquid receiver 4 including the volume in the pipe from the liquid receiver 4 to the inlet of the pump 5 is determined so that there remains a room for $CO_2$ gas in the upper part in the liquid receiver 4 when the operation of $CO_2$ brine cycle is halted, the level of the top part of the riser pipe 90 is level with or higher than the maximum liquid level of $CO_2$ in the liquid receiver 4, and further the top part of the riser pipe is connected to the gas layer in the liquid receiver 4*a* via the communication pipe, so movement of $CO_2$ brine can be interrupted smoothly after the operation of the liquid pump 5 is halted.

This is explained as follows: the liquid $CO_2$ at point B falls down to the point A or A' when the operation of the liquid pump 5 is stopped. Gaseous $CO_2$ enters through a gas introducing line connecting to the top part of the riser pipe and liquid $CO_2$ at point B comes down to level L. Thus, the transmission of heat by the medium of $CO_2$ in the $CO_2$ cycle can be interrupted smoothly as soon as the operation of the liquid pump 5 is halted.

Next, the state the liquid pump 5 is started and $CO_2$ is allowed to circulate will be explained.

It is necessary to restart the liquid pump 5 and allow $CO_2$ to be discharged from the pump that enough hydraulic head exists at the inlet of the liquid pump 5 in order to prevent the occurrence of cavitation at the inlet, so it is necessary that $CO_2$ is in a supercooled state when the liquid pump 5 is restarted. Therefore, in the fifth invention, it is suitable to provide a supercooler for supercooling the liquid $CO_2$ in the liquid receiver so that the liquid $CO_2$ in the liquid receiver or in the pipe connecting to the inlet of the liquid pump is maintained in a supercooled state.

Concretively, it is suitable that the judgment of the supercooled state is done by a controller which determines the degree of supercooling by calculating saturation temperature of $CO_2$ based on the detected pressure in the liquid receiver reserving the cooled and liquefied $CO_2$ and comparing the detected temperature of the liquid $CO_2$ in the liquid receiver.

For example, in FIG. 6(*a*), the liquid pump 5 can be smoothly started by starting in the state the liquid $CO_2$ in the liquid receiver is supercooled to a degree of subcooling of about 1~5° C.

As the height between point A and B in the riser pipe 90 is about 2.5 m, which corresponds to about 0.0279 MPa, the liquid pump 5 must overcome this head to allow $CO_2$ to circulate. $CO_2$ brine can not be circulated forcibly without this discharge head.

Therefore, in the fifth invention, a pressure sensor is provided for detecting the pressure difference between the outlet and inlet of the liquid pump 5, and the liquid pump 5 is operated to produce discharge head higher than actual head and loss of head in the piping. Although a part of $CO_2$ brine liquid is returned to the liquid receiver 4, a large part thereof is supplied to the cooler 6. The amount of returning brine is controlled by the size of diameter of the communication pipe 100 or by means of the flow control valve 102.

When the liquid pump is stopped, the pump does not produce discharge head to overcome said head of 2.5 m and circulation of $CO_2$ is ceased. $CO_2$ gas is introduced to the top part of the gas riser pipe 90 from the $CO_2$ gas layer in the liquid receiver 4 through the communication pipe 100 as soon as the operation of the system is halted.

Therefore, in the state the liquid pump 5 is not operated, $CO_2$ brine is not circulated, the level of the liquid $CO_2$ in the riser pipe 90 lowers, and saturated $CO_2$ vapor fills the space in the riser pipe 90 between point A-B-A'.

As mentioned before, it is necessary in the $CO_2$ circulation cycle provided with the liquid pump 5 and the riser pipe 90 to operate the liquid pump 5 to discharge 2 times or larger, preferably 3~4 times the circulation flow required by the heat exchanger in the refrigeration load side in order to allow $CO_2$ to flow in the return pipe 53 in a substantially liquid state, in a liquid or liquid/gas mixed state (incompletely evaporated state), so there is a danger that undesired pressure rise above the permissible design pressure of the pump could occur at starting of the liquid pump 5, for the starting is done in a condition of normal temperature.

Therefore, it is suitable to combine intermittent operation and rotation speed control of the pump to allow the pump to be operated under the discharge pressure lower than the designed permissible pressure.

Further, it is suitable as a safety design to provide a pressure relief passage connecting the cooler of the refrigeration load side and the $CO_2$ brine cooler 3 or the liquid receiver 4 provided downstream thereof in addition to the return passage connecting the outlet of the cooler to the $CO_2$ brine cooler 3 so that pressure of $CO_2$ is allowed to escape through the pressure relief passage when the pressure in the load side cooler exceeds a predetermined pressure (near the design pressure, for example, the pressure at 90% load of the designed refrigeration load).

Further, the system of the invention can be applied when a plurality of load side coolers are provided and $CO_2$ is supplied to the coolers through passages branching from the liquid pump, or when refrigeration load varies largely, or even when at least one of the coolers is of a top feed type.

Further, as a preferable embodiment of the present invention, it is suitable to provide a bypass passage between the outlet of the liquid pump and the $CO_2$ brine cooler 3 to bypass by means of a bypass valve attached to the bypass passage.

Further, as a preferable embodiment, it is suitable that a controller is provided to unload forcibly the compressor in the ammonia refrigerating cycle based on the detected pressure difference between the outlet and inlet of the liquid pump 5 and that a heat insulated joint is used at the joining part of the brine line of the $CO_2$ brine producing side with the brine line of the refrigeration load side.

Next, effect of returning $CO_2$ of a liquid or gas/liquid mixed state (incompletely evaporated state) recovered from the outlet of the refrigeration load side cooler 6 will be explained referring to FIG. 6(*b*). As shown in FIG. 6(*b*), the system is composed such that the brine cooler 3 is located at a height position higher than the liquid receiver 4, $CO_2$ of a liquid or gas/liquid mixed state recovered from the outlet of the refrigeration load side cooler 6 is returned to the $CO_2$ gas layer 4*a* in the liquid receiver 4, and the $CO_2$ gas layer 4*a* in the liquid receiver 4 is communicated to the brine cooler 3 via the piping 104 so that condensed and liquefied $CO_2$ brine is stored in the liquid receiver 4.

As the $CO_2$ recovered from the outlet of the refrigeration load side cooler 6 is in a liquid or gas/liquid mixed state (incompletely evaporated state), if it is returned to to the brine cooler 3, flow resistance in the brine cooler 3 increases and pressure load to the liquid pump 5 increases excessively, which may induce necessity of increasing the size of the liquid pump resulting in an increased size of the apparatus. However, by returning the $CO_2$ in a liquid or gas/liquid mixed state to the $CO_2$ gas layer 4*a* in the liquid receiver 4, back pressure of the liquid pump 5 can be reduced. Further, by introducing the $CO_2$ gas in the gas layer 4*a* in the liquid receiver 4 to the intercooler 3 via the piping 104 to condensate and liquefy it and returning the liquefied $CO_2$ to the liquid receiver 4 to be stored therein, condensing cycle can be carried out. Therefore, condensing and liquefying of $CO_2$ gas can be carried out without returning the $CO_2$ in a liquid or gas/liquid mixed state to the brine cooler 3.

As to other effects, the same results as described referring to FIG. 6(*a*) can be obtained.

REFERENCES

Figure 1A:
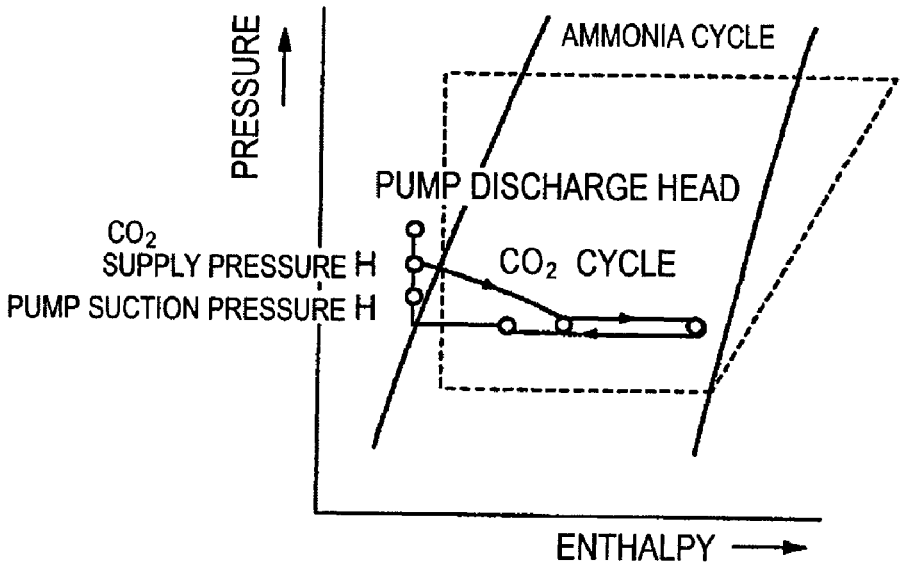
FIG. 1 represents pressure-enthalpy diagrams of combined refrigerating cycle of ammonia and $CO_2$, (A) is a diagram of the cycle when working in the system according to the present invention, and (B) is a diagram of the cycle when working in the system of prior art.
Figure 1B:
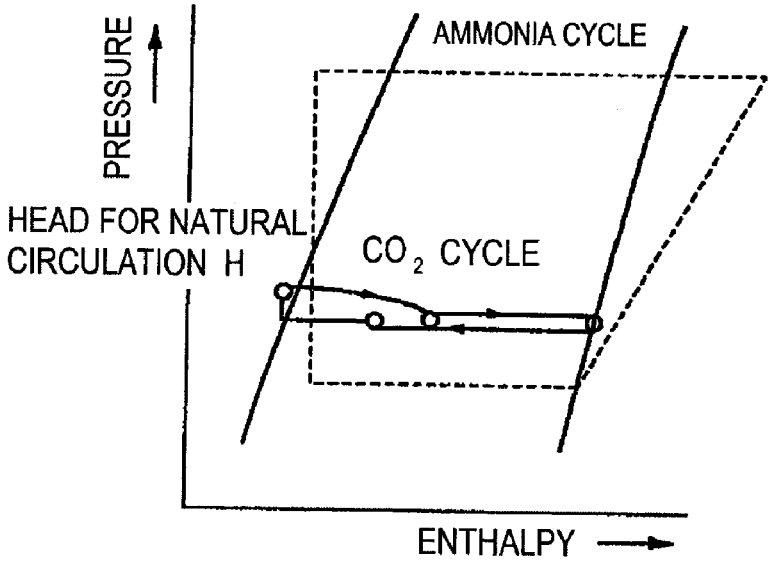

1 ammonia refrigerating machine (compressor)
2 evaporation type condenser
3 brine cooler
4 liquid receiver
5 liquid pump
6 cooler
7 ammonia detoxifying water tank
8 supercooler
53 recovery line
90 riser pipe
100 communication pipe
102 flow control valve
A machine unit (CO2 brine producing apparatus)
B freezer unit
CL controller
P1~P2 Pressure sensor
T1~T4 temperature sensor

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

FIG. 1(A) is a pressure-enthalpy diagram of the ammonia cycle and that of $CO_2$ cycle of the present invention, in which the broken line shows an ammonia refrigerating cycle and the solid line shows a $CO_2$ cycle of forced circulation. Liquid $CO_2$ produced in a brine cooler 3 and a liquid receiver 4 is supplied to a refrigeration load side by means of a liquid pump 5 to generate forced circulation of $CO_2$. The discharge capacity of the liquid pump is determined to be equal to or larger than two times the circulation flow required by the cooler side in which $CO_2$ of liquid or liquid/gas mixed state (imperfectly evaporated state) can be evaporated in order to allow $CO_2$ to be recovered to the brine cooler in a liquid state or liquid/gas mixed state. As a result, even if the brine cooler is located at the position lower that the refrigeration load side cooler, liquid $CO_2$ can be supplied to the refrigeration load side cooler and $CO_2$ can be returned to the brine cooler even if it is in a liquid or liquid/gas mixed state because enough pressure difference can be secured between the outlet of the cooler and the inlet of the brine cooler 3. (This is shown in FIG. 1(A) in which $CO_2$ cycle is returned before entering the gaseous zone.)

Therefore, as the system is constituted such that CO2 of liquid or liquid/gas mixed state can be returned to the brine cooler capable of allowing evaporation in a liquid or liquid/gas mixed state (incompletely evaporated state) even if there is not enough hydraulic head between the brine cooler and the refrigeration load side cooler and there is a somewhat long distance between them, the system can be applied to all of refrigeration system for cooling a plurality of rooms (coolers) irrespective of the type of cooler such as bottom feed type or top feed type.

Various corresponding block diagrams are shown in FIG. 2. In the drawings, reference symbol A is a machine unit integrating an ammonia refrigerating cycle section and a machine unit (CO2 brine producing apparatus) integrating a heat exchanging section of ammonia/CO2 (which includes a brine cooler and a CO2 pump) and reference symbol B is a freezer unit for cooling (freezing) refrigeration load side by the latent heat of vaporization and sensible heat of the $CO_2$ brine (liquid $CO_2$) produced in the machine unit A.

Next, the construction of the machine unit A will be explained.

Reference numeral 1 is a compressor. Ammonia gas compressed by the compressor 1 is condensed in a condenser 2, then the condensed liquid ammonia is expanded at the expansion valve 23 to be introduced through line 24 to a $CO_2$ brine cooler 3 to be evaporated therein while exchanging heat, and the evaporated ammonia gas is introduced into the compressor 1, thus an ammonia refrigerating cycle is performed. (see FIG. 3)

$CO_2$ brine is, after $CO_2$ of gas/liquid state is recovered from the freezer unit B, is introduced to the brine cooler 3, where the mixture of liquid and gaseous $CO_2$ is cooled to be condensed by heat exchange with ammonia refrigerant. The condensed liquid $CO_2$ is stored in the liquid receiver 4, then returned to the freezer unit B by means of a liquid pump 5 which is driven by an inverter motor of variable rotation speed and capable of intermittent rotation.

A volume including the volume of the liquid receiver 4 and the volume in the piping to the inlet of the liquid pump 5 when the $CO_2$ brine cycle is halted is determined to be the sum of the volume of $CO_2$ brine liquid recovered into the liquid receiver 4 and the volume of the $CO_2$ gas layer above the $CO_2$ brine liquid, and height level of the top part of the riser pipe is determined to be equal or higher than that of maximum level L of the $CO_2$ brine liquid stored in the liquid receiver 4.

The $CO_2$ gas layer in the liquid receiver 4 is communicated to the top part of the riser pipe 90 via the communication pipe 100, a part of $CO_2$ brine liquid is returned to the liquid receiver 4 via the communication pipe 100 when the liquid pump is operated, and $CO_2$ gas residing in the upper part of the liquid receiver 4 flows to the top part of the riser pipe 90.

Next, the freezer unit B will be explained. The freezer unit B has a $CO_2$ brine line between the discharge side of the liquid pump 5 and the inlet side of the brine cooler 3, on the line is provided one or a plurality of coolers 6 capable of allowing evaporation in a liquid or liquid/gas mixed state (imperfectly evaporated state). The liquid $CO_2$ introduced to the freezer unit B is partly evaporated in the cooler or coolers 6, and $CO_2$ is returned to the $CO_2$ brine cooler of the machine unit A in a liquid or liquid/gas mixed stat, thus a secondary refrigerant cycle of $CO_2$ is performed.

Figure 2B:
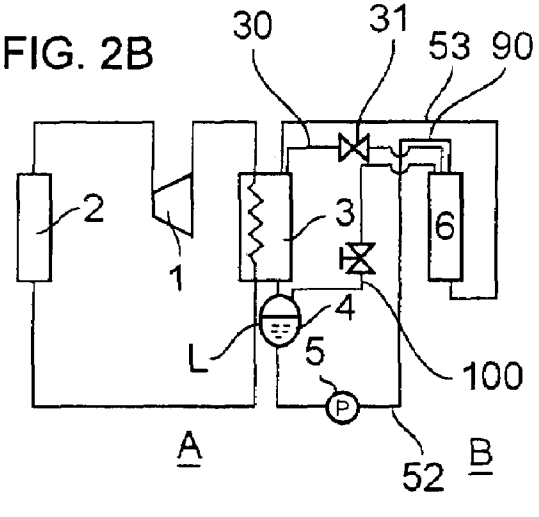
FIGS. 2(A)~(E) are a variety of connection diagrams of the present invention.
Figure 2A:
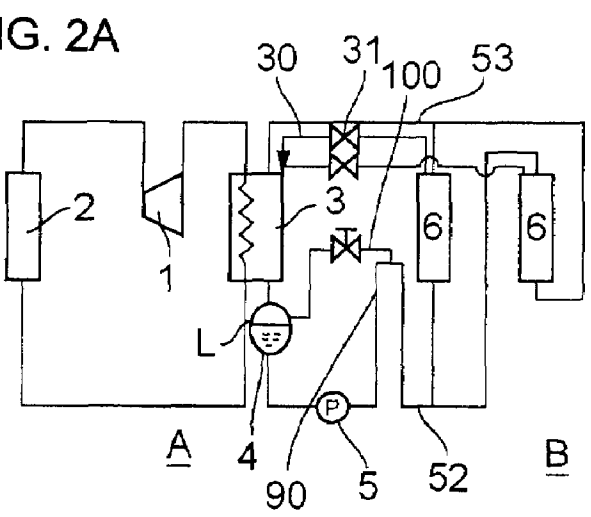

In FIG. 2(A), a top feed type cooler 6 and a bottom feed type cooler 6 are provided downstream of the liquid pump 5.

A relief line 30 provided with a safety valve or pressure regulation valve 31 is provided between the coolers 6 capable of allowing evaporation in a liquid or liquid/gas mixed state and the brine cooler 3 in order to prevent undesired pressure rise due to gasified $CO_2$ which may tend to occur in the bottom feed type cooler and pressure rise on start up in addition to a recovery line 53 which is provided between the coolers 6 and the brine cooler 3. When the pressure in the coolers 6 rise above a predetermined pressure, the pressure regulation valve 31 opens to allow $CO_2$ to escape through the relief line 30.

FIG. 2(B) is an example when a single top feed type cooler is provided. In this case also a relief line 30 provided with a safety valve or pressure regulation valve 31 is provided between the coolers 6 capable of allowing evaporation in a liquid or liquid/gas mixed state and the brine cooler 3 or the liquid receiver 4 provided in the downstream of the brine cooler in order to prevent pressure rise on start up in addition to a recovery line 53 which is provided between the coolers 6 and the brine cooler 3.

Figure 2E:
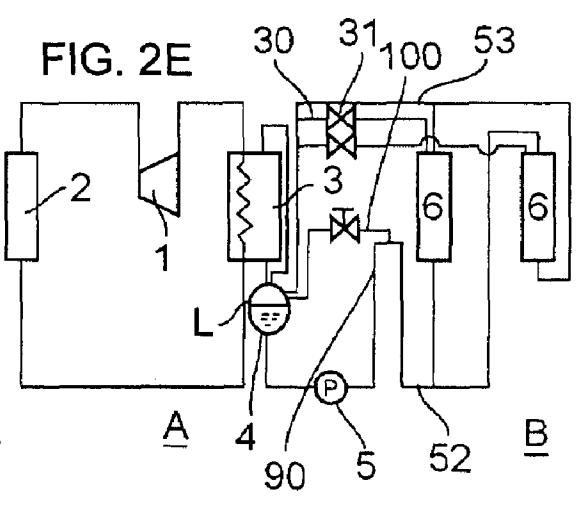
Figure 2D:
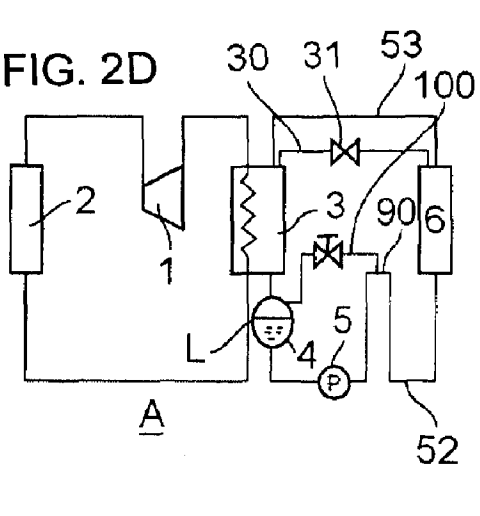
Figure 2C:
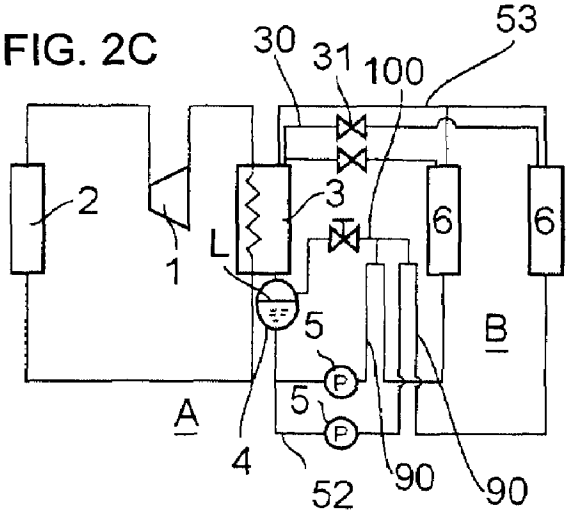

FIG. 2(C) is an example in which a plurality of liquid pumps are provided in the feed line 52 at outlet side of the brine cooler 3 for feeding $CO_2$ to bottom feed type coolers 6 to generate forced circulation respectively independently. Also in the case of the example, $CO_2$ brine is pressure fed by the liquid pump to be introduced to the freezer unit B via the riser pipe 90.

With the construction like this, even if there is not enough hydraulic head between the brine cooler 3 and the refrigeration load side cooler 6 and there is a somewhat long distance between them, required amount of $CO_2$ can be circulated forcibly. The discharge capacity of each of the pumps 5 should be above two times the flow required for each of the coolers 6 in order that $CO_2$ can be recovered in a liquid or liquid/gas mixed state.

FIG. 2(D) is an example when a single bottom feed type cooler is provided. In the case of the example also $CO_2$ brine is pressure fed by the liquid pump to be introduced to the freezer unit B via the riser pipe 90.

In this case also a relief line 30 provided with a safety valve or pressure regulation valve 31 is provided between the coolers 6 and the brine cooler 3 in order to prevent pressure rise due to gasified $CO_2$ and pressure rise on start up in addition to a recovery line 53 which is provided between the coolers 6 and the brine cooler 3.

A configuration was explained referring to In FIG. 2(A) to FIG. 2(D), in which a part of liquid $CO_2$ introduced to the freezer unit is evaporated in the cooler 6 and returned to the brine cooler 3 in the machine unit in a liquid or gas/liquid mixed state, it is also suitable that to configure such that said returning is to $CO_2$ layer in the liquid receiver 4. For example, a configuration in which said returning is to the $CO_2$ layer in the liquid receiver 4 in the case of FIG. 2(A) is shown in FIG. 2(E).

EXAMPLE 1

Figure 3:
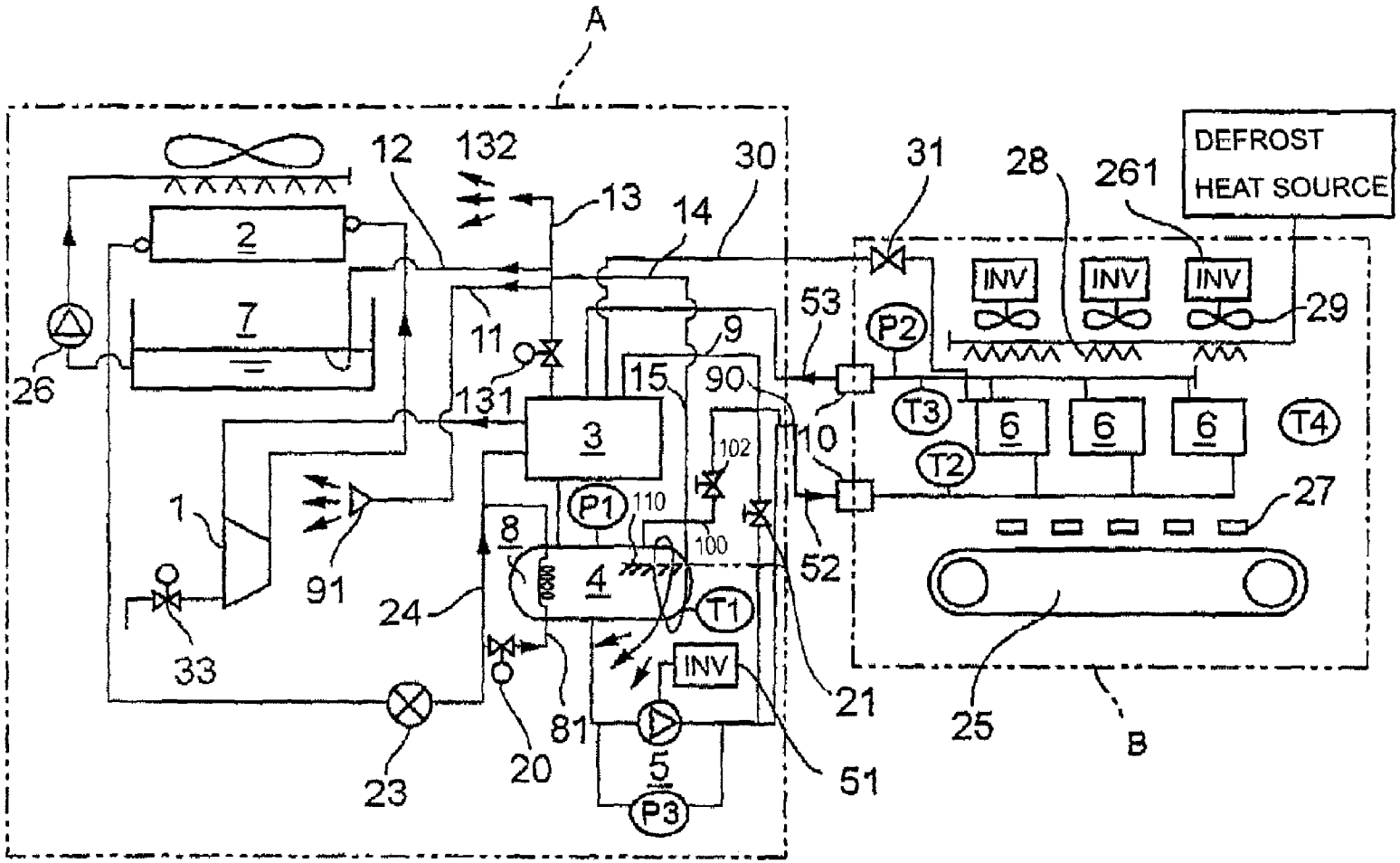
FIG. 3 is a schematic representation of the preset invention showing the total configuration schematically, consisting of a machine unit ($CO_2$ brine producing unit) containing an ammonia refrigerating cycle section and an ammonia/$CO_2$ heat exchanging section and a freezer unit for refrigerating refrigeration load by utilizing latent heat of vaporization of liquid $CO_2$ brine cooled in the machine unit side to a liquid state.

FIG. 3 is a schematic representation of the refrigerating apparatus of forced $CO_2$ circulation type in which $CO_2$ brine which has cooled a refrigeration load with its latent heat of vaporization is returned to be cooled through the heat exchange with ammonia refrigerant.

In FIG. 3, reference symbol A is a machine unit ($CO_2$ brine producing apparatus) integrating an ammonia refrigerating cycle part (brine cooler 3) and an ammonia/$CO_2$ heat exchanging part (brine cooler 3), and B is a freezer unit for cooling (refrigerating) a refrigeration load by utilizing the latent heat of vaporization of $CO_2$ cooled in the machine unit side.

Next, the machine unit A will be explained.

Figure 4:
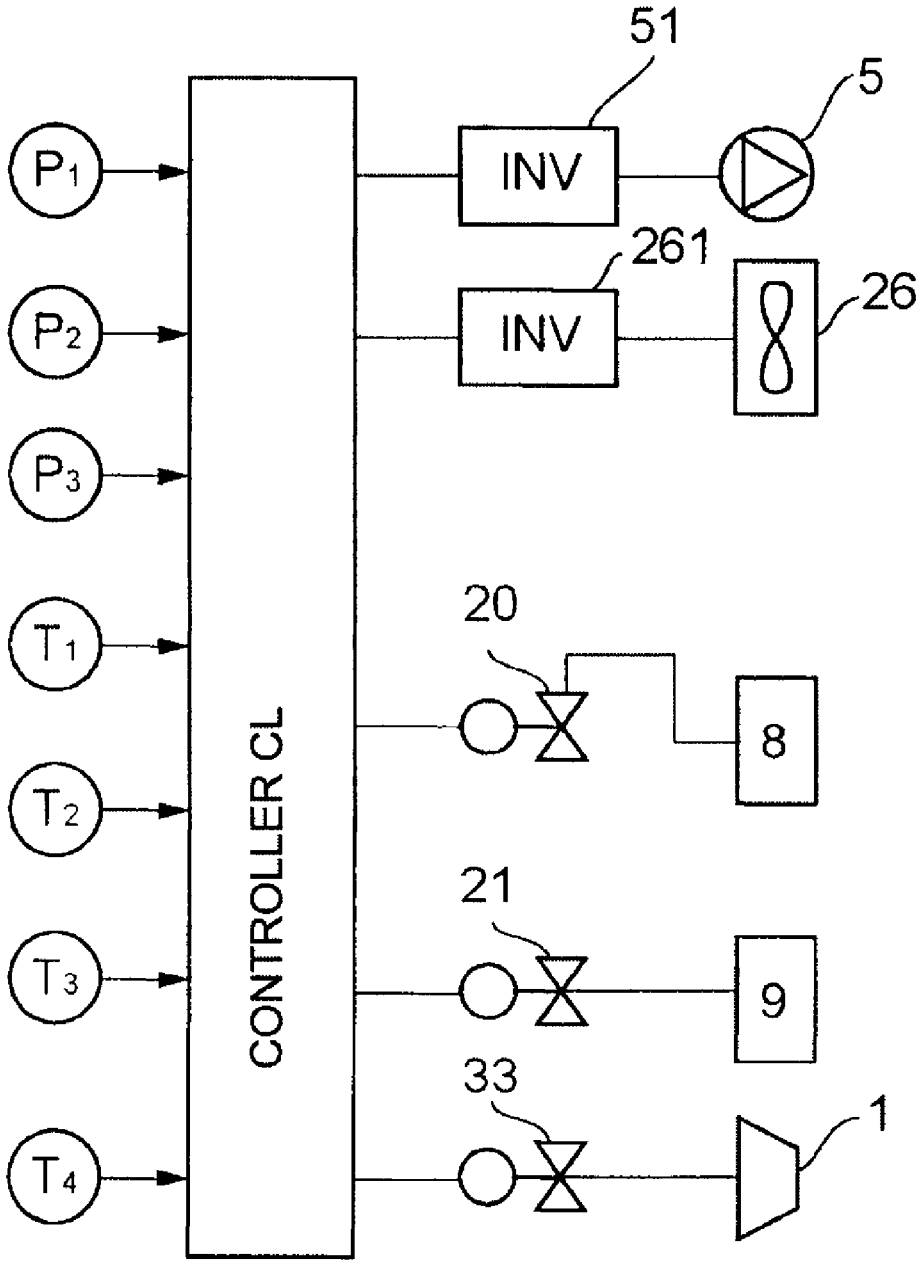
FIG. 4 is a flow diagram of FIG. 3.

In FIG. 4, reference numeral 1 is a compressor, the ammonia gas compressed by the compressor 1 is condensed in an evaporation type condenser 2, and the condensed liquid ammonia is expanded at an expansion valve 23 to be introduced into a $CO_2$ brine cooler 3 through a line 24. The ammonia evaporates in the brine cooler 3 while exchanging heat with $CO_2$ and introduced to the compressor 1 again to complete an ammonia cycle. Reference numeral 8 is a supercooler connected to a bypass pipe bypassing the line 24 between the outlet side of the expansion valve 23 and the inlet side of the brine cooler 3, the supercoller 8 being integrated in a $CO_2$ liquid receiver 4.

The riser pipe 90 is provided to the outlet of the liquid pump 5. After $CO_2$ gas is recovered from the freezer unit B via the insulated joint 10, $CO_2$ brine is introduced to the brine cooler 3 for cooling the $CO_2$ brine, $CO_2$ is cooled to be condensed through heat exchange with ammonia refrigerant, the condensed liquid $CO_2$ is introduced to the liquid receiver 4 to be cooled by the supercooler 8 to a temperature lower than its saturation temperature in the liquid receiver 4 by 1~5 degrees C.

The supercooled liquid $CO_2$ is introduced to the freezer unit B side by means of a liquid pump 5 provided in a $CO_2$ feed line 52 and driven by an inverter motor 51 of variable rotation speed.

The top part of the riser pipe 90 is communicated to the $CO_2$ gas layer in the upper part in the liquid receiver 4 via the communication pipe 100. $CO_2$ brine liquid returned to the liquid receiver 4 is controlled by the size of the diameter of the communication pipe 100 or by the flow control valve 102 so that a part of the $CO_2$ brine liquid supplied by the liquid pump 5 and a large part thereof is supplied to the cooler 6. When the liquid pump 5 is not operating, the $CO_2$ gas residing in the upper part in the liquid receiver 4 is supplied to the top part of the riser pipe 90.

Reference numeral 9 is a bypass passage connecting the outlet side of the liquid pump 5 and the $CO_2$ brine cooler 3, and 11 is an ammonia detoxifying line, which connects to a detoxification nozzle 91 from which liquid $CO_2$ or liquid/gas mixed $CO_2$ from the $CO_2$ brine cooler 3 is sprayed to spaces where ammonia may leak such as near the compressor 1 by way of open/close valve 911.

Reference numeral 12 is a neutralization line through which $CO_2$ is introduced from the $CO_2$ brine cooler 3 to the detoxifying water tank 7 to neutralize ammonia to ammonium carbonate.

Reference numeral 13 is a fire extinguishing line. When a fire occurs in the unit, a valve 131 opens to allow $CO_2$ to be sprayed to extinguish the fire, the valve 131 being composed to be a safety valve which opens upon detecting a temperature rise or upon detecting an abnormal pressure rise of $CO_2$ in the brine cooler 3.

Reference numeral 14 is a $CO_2$ relief line. When temperature rises in the unit A, a valve 151 is opened and $CO_2$ in the $CO_2$ brine cooler 3 is allowed to be released into the space inside the unit through an injection line 15 surrounding the liquid receiver 4 to cool the space. The valve 151 is composed as a safety valve which opens when the pressure in the brine cooler rises above a predetermined pressure during operation under load.

Next, the freezer unit B will be explained.

In the freezer unit B, a plurality of $CO_2$ brine coolers 6 are located above a conveyor 25 for transferring foodstuffs 27 to be frozen along the transfer direction of the conveyor. Liquid $CO_2$ introduced through the heat insulated joint 10 is partially evaporated in the coolers 6, air brown toward the foodstuffs 27 by means of cooler fans 29 is cooled by the coolers 6 on its way to the foodstuffs.

The cooler fans 29 are arranged along the conveyor 25 and driven by inverter motors 261 so that the rotation speed can be controlled.

Defrosting spray nozzles 28 communicating to a defrost heat source are provided between the cooler fans 29 and the coolers 6.

Gas/liquid mixed $CO_2$ generated by the partial evaporation in the coolers 6 returns to the $CO_2$ brine cooler 3 in the machine unit A through the heat insulated joint 10, thus a secondary refrigerant cycle is performed.

A relief line 30 provided with a safety valve or pressure regulation valve 31 is provided between the coolers 6 capable of allowing evaporation in a liquid or liquid/gas mixed state and the brine cooler 3 or the liquid receiver 4 provided in the downstream of the brine cooler in order to prevent undesired pressure rise due to gasified $CO_2$ and pressure rise on start up in addition to a recovery line for connecting the outlet side of each of the coolers 6 and the brine cooler 3.

The working of the embodiment example like this will be explained with reference to FIG. 4. In FIG. 3 and FIG. 4, reference symbol $T_1$ is a temperature sensor for detecting the temperature of liquid $CO_2$ in the liquid receiver 4, $T_2$ is a temperature sensor for detecting the temperature of $CO_2$ at the inlet side of the freezer unit B, $T_3$ is a temperature sensor for detecting the temperature of $CO_2$ at the outlet side of the freezer unit B, $T_4$ is a temperature sensor for detecting the temperature of the space in the freezer unit B, $P_1$ is a pressure sensor for detecting the pressure in the liquid receiver 4, $P_2$ is a pressure sensor for detecting the pressure in the coolers 6, $P_3$ is a pressure sensor for detecting the pressure difference between the outlet and inlet of the liquid pump 5, CL is a controller for controlling the inverter motor 51 for driving the liquid pump 5 and the inverter motors 261 for driving the cooler fans 29. Reference numeral 20 is a open/close control valve of a bypass pipe 81 for supplying ammonia to the supercooler 8, 21 is a open/close control valve of the bypass passage 9 connecting the outlet side of the liquid pump 5 and the $CO_2$ brine cooler 3.

The embodiment example is composed such that the controller CL is provided for determining the degree of supercool by comparing saturation temperature and detected temperature of the liquid $CO_2$ based on the signals from the sensor $T_1$ and $P_1$ and the amount of ammonia refrigerant introduced to the bypass pipe 8 can be adjusted. By this, the temperature of $CO_2$ in the liquid receiver 4 can be controlled to be lower than saturation temperature by 1~5° C.

The supercooler 8 may be provided outside the liquid receiver 4 independently not necessarily inside the liquid receiver 4.

By composing like this, all or a part of the liquid $CO_2$ in the liquid receiver 4 can be supercooled by the supercooler 8 stably to a temperature of desired degree of supercooling.

The signal from the sensor $P_2$ detecting the pressure in the coolers 6 capable of allowing evaporation in a liquid or liquid/gas mixed state (imperfectly evaporated state) is inputted to the controller CL which controls the inverter motors 51 to adjust the discharge of the liquid pump 5 (the adjustment including stepless adjustment of discharge and intermittent discharging), and stable supply of $CO_2$ to the coolers 6 can be performed through controlling the inverter 51.

Further, the controller CL controls also the inverter motor 261 based on the signal from the sensor $P_2$, and the rotation speed of the cooler fan 29 is controlled together with that of the liquid pump 5 so that $CO_2$ liquid flow and cooling air flow are controlled adequately.

The liquid pump 5 for feeding $CO_2$ brine to freezer unit B side discharged 3~4 times the amount of $CO_2$ brine required by the refrigeration load side (freezer unit B side) to generate forced circulation of $CO_2$ brine, and the coolers 6 is filled with liquid $CO_2$ and the velocity of liquid $CO_2$ is increased by use of the inverter 51 resulting in an increased heat transmission performance.

Further, as liquid $CO_2$ is circulated forcibly by means of the liquid pump 5 of variable discharge (with inverter motor) having discharge capacity of 3~4 times the flow necessary for the refrigeration load side, distribution of fluid $CO_2$ to the coolers 6 can be done well even in the case a plurality of coolers are provided.

Further, when the degree of supercool decreases when starting or refrigeration load varies and pressure difference between the outlet and inlet of the pump 5 decreases and cavitating state occurs, the sensor $P_3$ detecting the pressure difference detects that the pressure difference between the outlet and inlet of the pump has decreased, the controller CL allows the open/close control valve 21 on the bypass passage 9 to open, and $CO_2$ is bypassed to the brine cooler 3 for cooling $CO_2$ brine, as a result the gas of the gas/fluid mixed state of $CO_2$ in a cavitating state can be liquefied.

Said controlling can be done in the ammonia cycle in such away that, when the degree of supercool decreases when starting or refrigeration load varies and pressure difference between the outlet and inlet of the pump 5 decreases and cavitating state occurs, the pressure sensor $P_3$ detects that pressure difference between the outlet and inlet of the liquid pump 5 has decreased, the controller CL controls a control valve to unload the compressor 1 (displacement type compressor) to allow apparent saturation temperature of $CO_2$ to rise to secure the degree of supercool.

Figure 5:
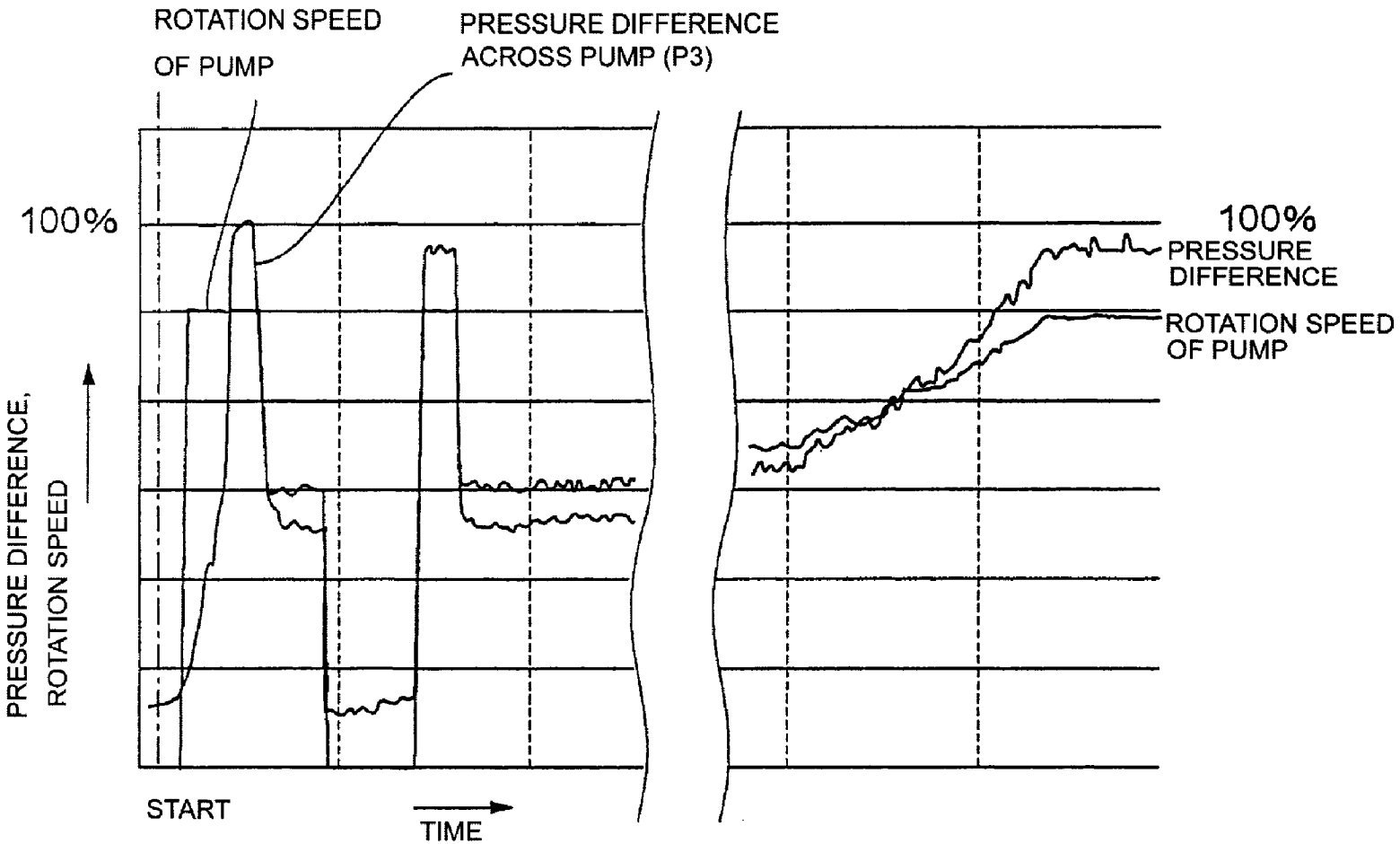
FIG. 5 is a graph showing changes of rotation speed of the liquid pump and pressure difference between the outlet and inlet of the liquid pump of the present invention.
Figure 6A:
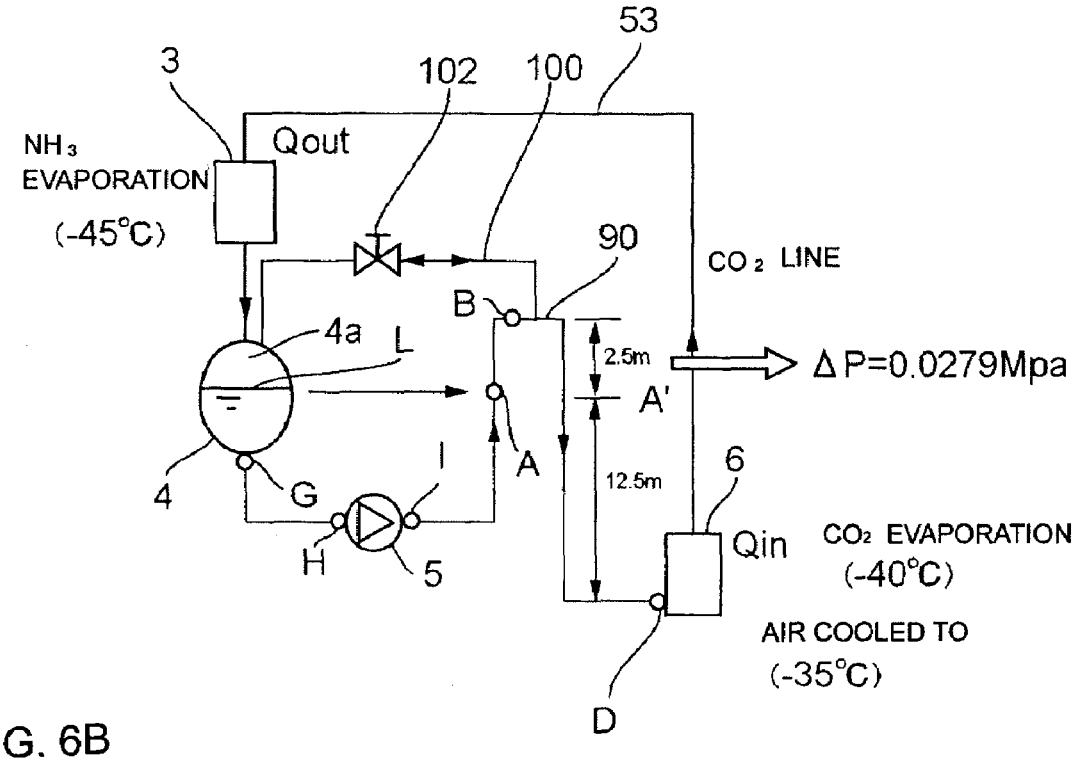
FIG. 6 is a connection diagram to explain the effect of the riser pipe provided in the fifth invention.
Figure 6B:
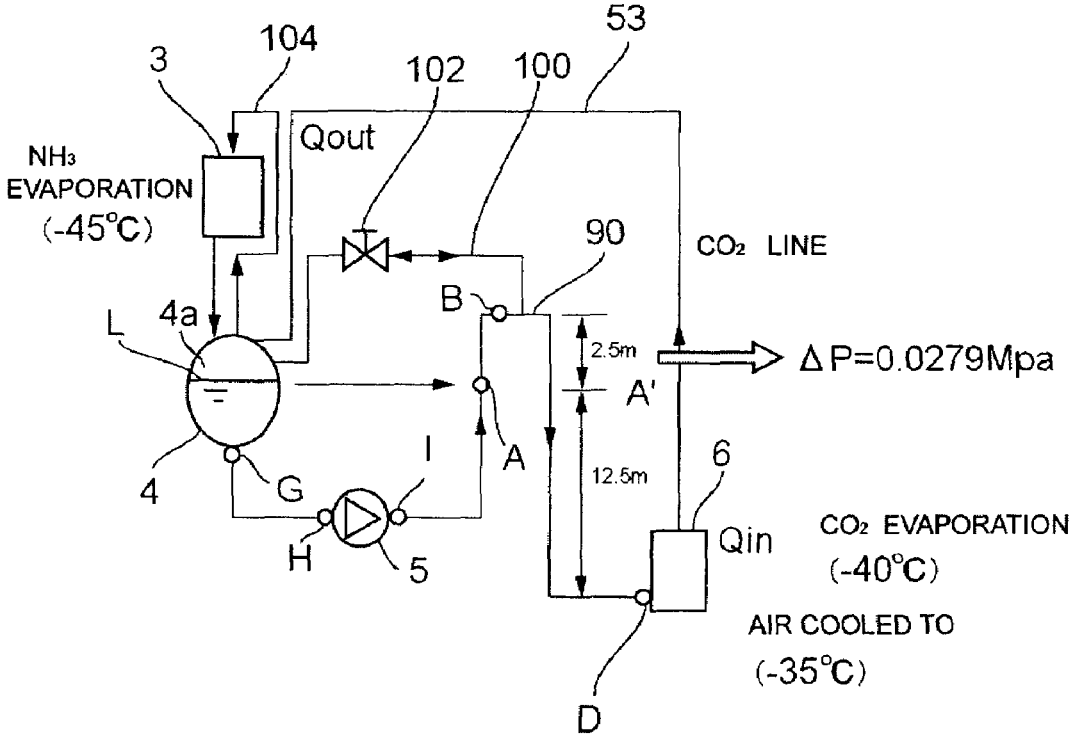

Next, operating method of the embodiment example will be explained with reference to FIG. 5.

First, the compressor 1 in the ammonia cycle side is operated to cool liquid $CO_2$ in the brine cooler 3 and the liquid receiver 4. On startup, the liquid pump 5 is operated intermittently/cyclically.

Concretively, the liquid pump 5 is operated at 0%→100%→60%→0%→100%→60% rotation speed. Here, 100% rotation speed means that the pump is driven by the inverter motor with the frequency of power source itself, and 0% means that the operation of the pump is halted. By operating in this way, the pressure difference between the outlet and inlet of the pump can be prevented from becoming larger than the design pressure.

First, the pump is operated under 100%, when the pressure difference between the outlet and inlet of the pump reaches the value of full load operation (full load pump head), lowered to 60%, then operation of the liquid pump is halted for a predetermined period of time, after this again operated under 100%, when the pressure difference between the outlet and inlet of the pump reaches the value of full load operation (full load pump head), lowered to 60%, then shifted to normal operation while increasing inverter frequency to increase the rotation speed of the pump.

By operating in this way, the occurrence of undesired pressure rise pressure rise above design pressure of the pump can be eliminated, for the operation of the system is started in a state of normal temperature also in the case the discharge capacity of the liquid pump is determined to be larger than 2 times, preferably 3~4 timed the forced circulation flow required by the coolers capable of allowing evaporation in a liquid or liquid/gas mixed state (imperfectly evaporated state).

As the top part of the riser pipe 90 is communicated to the $CO_2$ gas layer in the liquid receiver 4 via the communication pipe 100 and the amount of $CO_2$ brine liquid returned is controlled by controlling the size of diameter of the communication pipe 100 and opening/closing of flow control valve 102, refrigeration load can be adjusted as desired.

When sanitizing the freezer unit after freezing operation is over, CO2 in the freezer unit B must be recovered to the liquid receiver 4 by way of the brine cooler 3 of the machine unit. The recovery operation can be controlled by detecting the temperature of liquid $CO_2$ at the inlet side and that of gaseous $CO_2$ at the outlet side of the coolers 6 by the temperature sensor $T_2$, $T_3$ respectively, grasping by the controller CL the temperature difference between the temperatures detected by $T_2$ and $T_3$, and judging the remaining amount of $CO_2$ in the freezer unit B. That is, it is judged that recovery is completed when the temperature difference becomes zero.

The recovery operation can be controlled also by detecting the temperature of the space in the freezer unit and the pressure of $CO_2$ at the outlet side of the cooler 3 by the temperature sensor $T_4$ and pressure sensor $P_3$ respectively, comparing the space temperature detected by the sensor $T_4$ with saturation temperature of $CO_2$ at the pressure detected by the sensor $P_3$, and judging on the basis of the difference between the saturation temperature and the detected space temperature whether $CO_2$ remains in the freezer unit B or not.

In the case the coolers 6 are of sprinkled water defrosting type, time needed for $CO_2$ recovery can be shortened by utilizing the heat of sprinkled water. In this case, it is suitable to perform defrost control in which the amount of sprinkling water is controlled while monitoring the pressure of $CO_2$ at the outlet side of the coolers 6 detected by the sensor $P_2$.

Further, as foodstuffs are handled in the freezer unit B, high-temperature sterilization of the unit may performed when an operation is over. So, the connecting parts of $CO_2$ lines of the machine unit A to those of the freezer unit B are used heat insulated joint made of low heat conduction material such as reinforced glass, etc. so that the heat is not conducted to the $CO_2$ lines of the machine unit A through the connecting parts.

When refrigeration is finished and operation of the liquid pump 5 is stopped, $CO_2$ gas is introduced to the top part of the riser pipe 90 from the $CO_2$ gas layer in the liquid receiver 4 via the communication pipe 100 as soon as the liquid pump 5 is stopped. Therefore, circulation of liquid $CO_2$ is interrupted, $CO_2$ residing in the rising part upstream of the connecting part of the communication pipe 100 comes in to balance with the $CO_2$ gas in the liquid receiver 4 by a liquid level 110, liquid $CO_2$ which has already passed the top part of the riser pipe 90 reaches the cooler 6, where it receives heat for defrosting and high-temperature sterilization and evaporates rapidly and recovered to the liquid pump 5. Therefore, fears of occurrence of explosive evaporation (boiling) of liquid $CO_2$ is erased by complete recovery of the liquid $CO_2$ without delay, whereas it may occur if liquid $CO_2$ remains in the circulation path near the cooler 6 when carrying out water spray defrosting and high-temperature sterilization.

EMBODIMENT EXAMPLE 2

Next, the second embodiment of the present invention applied to an ice-making factory will be explained with reference to FIG. 7.

This embodiment consists of an evaporation type condenser unit A1 for $NH_3$, a machine unit A2, and an ice-making room B. All of the units are installed on the ground level (on the earth) and there is no difference between them in height level from the earth.

Figure 7:
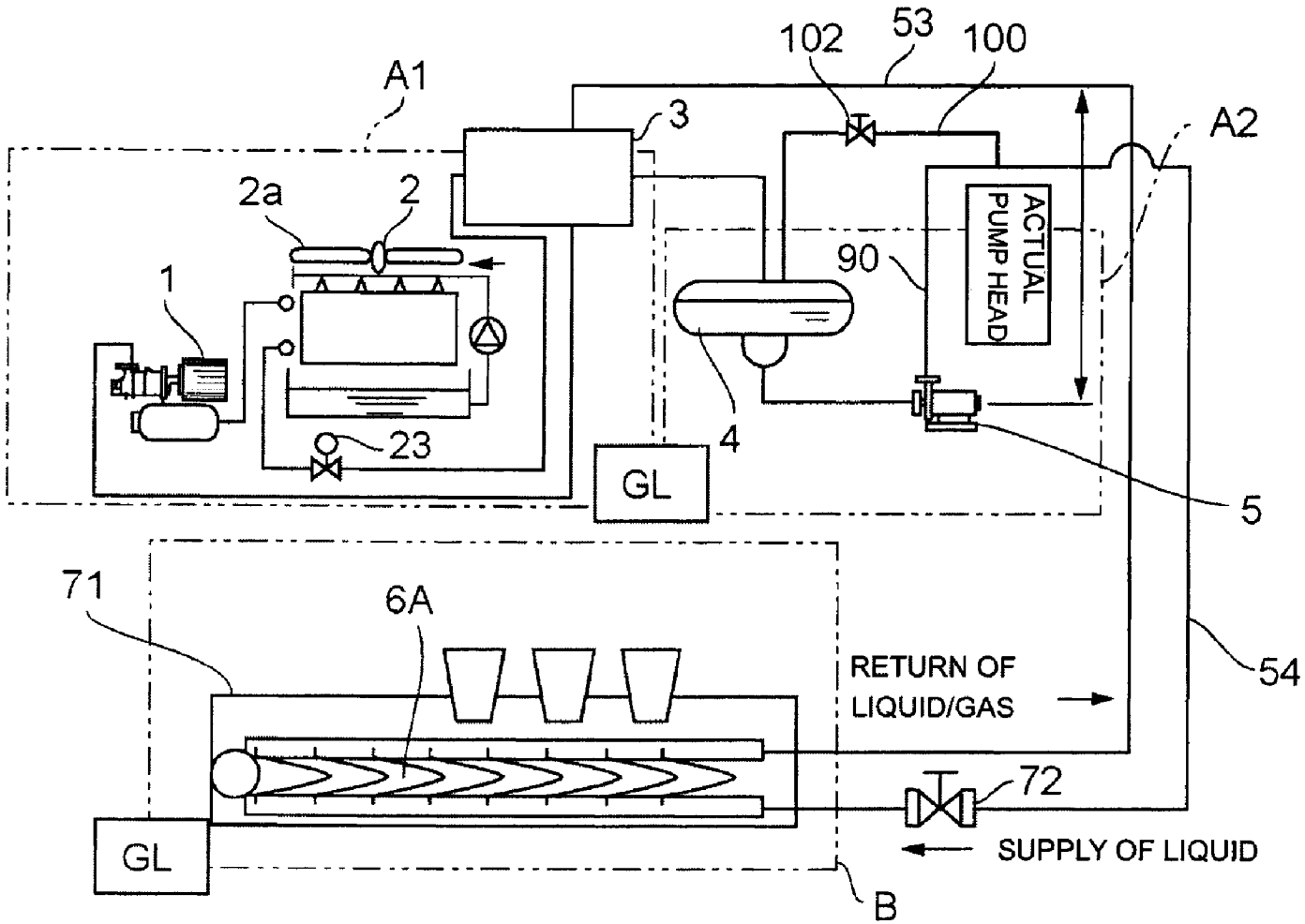
FIG. 7 is a schematic representation of the present invention applied to an ice making factory.

In FIG. 7, GL means that all of the unit A1, unit A2, and room B are installed on the ground level. The $NH_3$ evaporation type condenser unit A1 is an ammonia refrigerating machine comprising an ammonia compressor 1, an evaporating type condenser 2, an expansion valve 23, and a brine cooler 3, being located at high position near the ceiling of the evaporating type condenser unit A. Ammonia gas compressed by the compressor is cooled in the evaporation type condenser 2 which is cooled by sprinkled water and air blown by a cooling fan 2*a*, the condensed liquid ammonia is expanded at the expansion valve 23 to be introduced into the brine cooler 3 where $CO_2$ brine is cooled by the latent heat of vaporization of the ammonia introduced thereinto.

The machine unit A2 is located adjacent to the evaporation type condenser unit A1 on the same ground level but it is formed to have a ceiling positioned a little lower than that of the evaporation type condenser unit A1. The machine unit contains a liquid receiver 4 for receiving the liquid ammonia cooled and condensed in the brine cooler 3 contained in the evaporation type condenser unit A1, a brine pump 5 of variable rotation speed, and a riser pipe 90. The riser pipe 90 is formed such that its top part runs in a position higher than the liquid level in the liquid receiver 4 and level with or a little lower than the top part of a return pipe 53 for returning $CO_2$ from the ice-making room B to the brine cooler 3, the top part of the return pipe 53 running in a position level with or a little higher than the top of the brine cooler 3.

Basically, it is permissible if the level of the top part of the riser pipe 90 is higher than the maximum liquid level in the brine cooler 3. In the embodiment, the top part of the riser pipe 90 runs in the duct under the roof in which the top part of the return pipe 53 runs, the return pipe 53 being designed in consideration of actual discharge head of the brine pump 5 and pressure loss in the return pipe.

The volume of the liquid receiver 4 including the volume in the pipe connecting to the inlet of the liquid pump 5 is determined so that there remains a room for $CO_2$ gas in the upper part in the liquid receiver 4 in addition to the liquid $CO_2$ in the brine cycle when the operation of $CO_2$ brine cycle is halted.

The brine pump 5 is a liquid pump for allowing forced circulation of $CO_2$ and its discharge capacity is determined at least equal to or larger than 2 times the circulation flow required by the cooler side so that $CO_2$ is recovered from the outlet of the cooler in the refrigeration load side in a state of liquid or in a substantially liquid state although mixed with gaseous $CO_2$.

Concretively, the brine pump 5 is driven to achieve a discharge head to overcome the liquid $CO_2$ head in the piping and pressure loss in the piping, and is located so that enough suction pressure is secured. The pressure in the suction side of the pump 5 must be above saturation pressure even when the pump is operating at maximum discharge, and it is necessary that the liquid receiver 4 containing supercooled $CO_2$ is located at a position at least higher than the suction side of the pump.

Although the ice-making room B is distant from the machine unit A2 and the evaporation type condenser unit A1, they are installed on the same ground level. In the ice-making room is located a calcium chloride brine tank 71 in which a herringbone coil 6A (evaporator) for $CO_2$ brine is accommodated. Liquid $CO_2$ is supplied to the coil 6A (evaporator) through the riser pipe 90 and a liquid valve 72. The liquid $CO_2$ evaporates in the coil 6A and cools the calcium chloride brine in the tank 71 with the latent heat of vaporization thereof and returns in a gas/liquid mixed state to the brine cooler 3 of the evaporation type condenser unit A1 through the return pipe 53 running in the duct 73 under the roof located at a position higher than the brine cooler 3.

Next, the working of the apparatus will be explained.

In the evaporation type condenser unit A1, ammonia gas compressed by the compressor 1 is condensed in the evaporation type condenser 2, the condensed liquid ammonia is expanded at the expansion valve to be introduced into the brine cooler 3 where the ammonia is evaporated while exchanging heat with $CO_2$, then the evaporated ammonia is again introduced to the compressor to complete an ammonia refrigerating cycle.

On the other hand, in a $CO_2$ cycle in the brine cooler and ice-making room, $CO_2$ is cooled and condensed through heat exchange with the ammonia refrigerant in the brine cooler 3, then the condensed liquid $CO_2$ is introduced to the liquid receiver 4 and cooled by a supercooler in the liquid receiver 4 (see FIG. 3) to a temperature lower than the saturation temperature of the $CO_2$ by 1~5° C.

As the forced circulation flow rate by the brine liquid pump 5 is determined to be two times or larger than the that required by the cooler 6, the supercooled liquid $CO_2$ can easily be fed under pressure by the brine pump 5 against the actual net liquid head to the top of the riser pipe 90.

The supercooled liquid $CO_2$ is introduced to the cooler (herringbone coil) 6A of the ice-making room by the hydraulic head (supply process of liquid $CO_2$ from the brine cooler 3 to the cooler 6A).

Calcium chloride brine is cooled in the cooler 6A by the latent heat of vaporization of the liquid $CO_2$. As the discharge of the brine pump 5 is determined to be at least 2 times or larger than the circulation flow required by the cooler 6A side, it does not occur that all of the $CO_2$ brine evaporates in the cooler 6A even under full load of refrigeration, and $CO_2$ brine can be returned to the brine cooler 3 in a liquid state or liquid/gas mixed state through the return piping 53 of which the top part runs in a duct provided in a position higher than the brine cooler 3 under the roof.

That is, as forced circulation of $CO_2$ brine from the brine cooler 3 through the cooler (herringbone coil) 6A to the brine cooler 3 is done by means of the liquid brine pump 5, the diameters of the riser pipe 90 and the return pipe 53 can be made small and the pipes can be provided to run in the duct located under roof in a positioned higher than the brine cooler 3 with the cooler 6A being located on the ground. Therefore, it is not necessary that piping runs extending around the cooler 6A and As to actions of the riser pipe 90 and communication pipe 100, they are the same as that explained in embodiment example 1.

EMBODIMENT EXAMPLE 5

Figure 8:
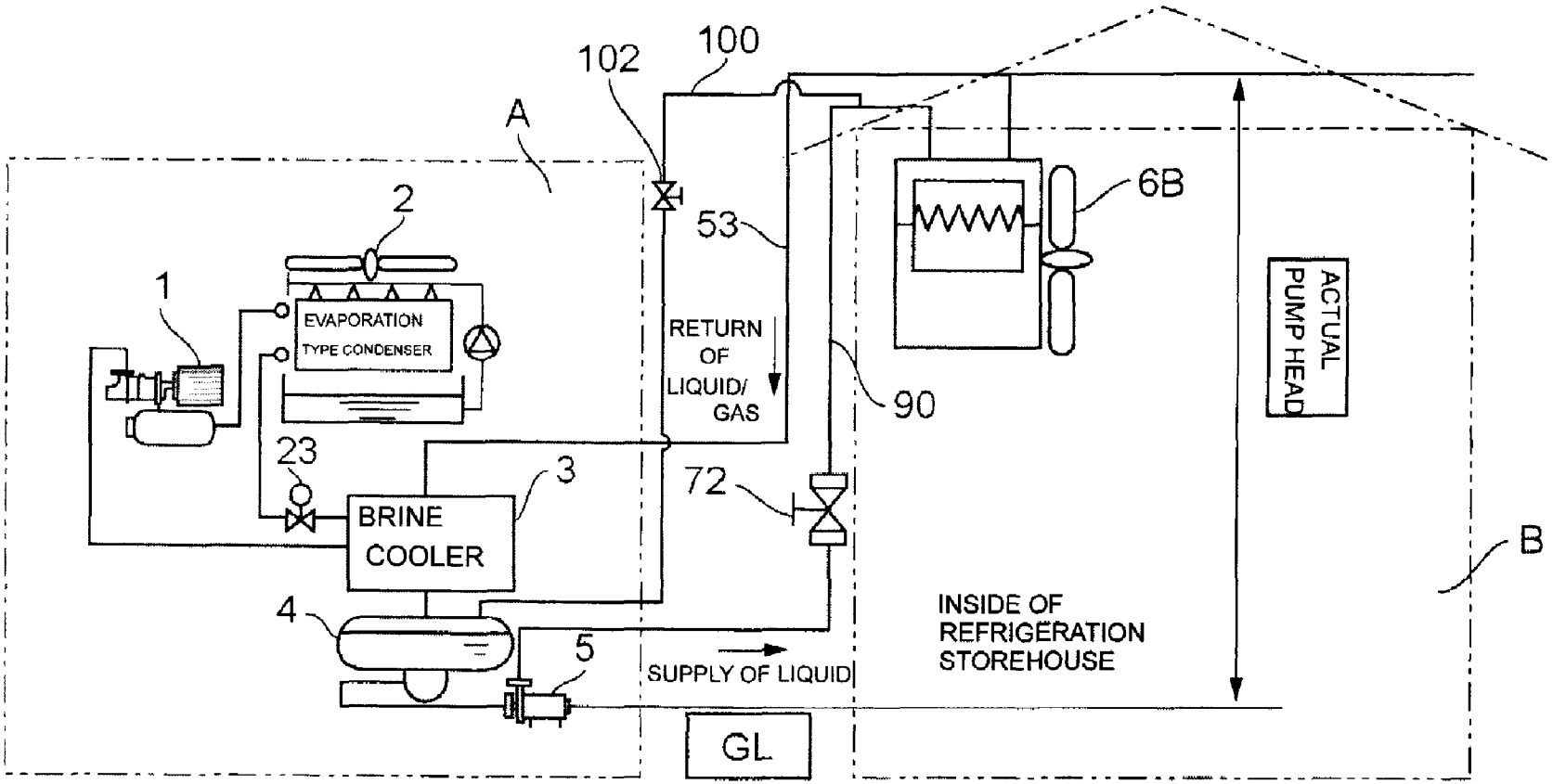
FIG. 8 is a schematic representation of the present invention applied to refrigeration storehouse.

FIG. 8 represents the third embodiment of the present invention. The embodiment relates to a refrigeration storehouse. In the drawing, the ($NH_3$) evaporation type condenser unit and the receiver unit of FIG. 12 are unitized as an outdoor unit A, and a hanger type air chiller 6B of $CO_2$ brine type is provided in a refrigeration storehouse B. A riser pipe 90 is provided to connect a brine pump 5 located in the outdoor unit A to the air chiller 6B in the refrigeration storehouse B. Both the outdoor unit A and refrigeration warehouse B are installed on the ground level (on the earth).

The outdoor unit A contains an ammonia compressor 1, evaporation type condenser 2, an expansion valve 23, and a brine cooler 3 to perform an ammonia refrigerating cycle, and a liquid receiver 4 and a brine liquid pump 5 is provided below the brine cooler 3. The discharge port of the pump 5 is connected to the air chiller 6B in the refrigeration storehouse B by means of a riser pipe 90.

The air chiller 6B is located near the ceiling of the refrigeration storehouse B at a position higher than the brine cooler, and the top part of the riser pipe 90 runs along a height position the same or higher than the return pipe for returning the $CO_2$ brine from the air chiller 6B to the brine cooler 3.

The configuration of the embodiment is similar to that of the embodiment of FIG. 12 other than the above-mentioned point, but in this embodiment, the air chiller 6B is a hanger type air chiller of $CO_2$ brine type hanging from the ceiling and located in a higher position than the brine cooler. The system according to the invention can be applied even in the case the air chiller 6B is located at a higher than the brine cooler 3 like this without problems. In FIG. 8, GL means that the unit A and B are on the ground level.

EMBODIMENT EXAMPLE 4

Figure 9:
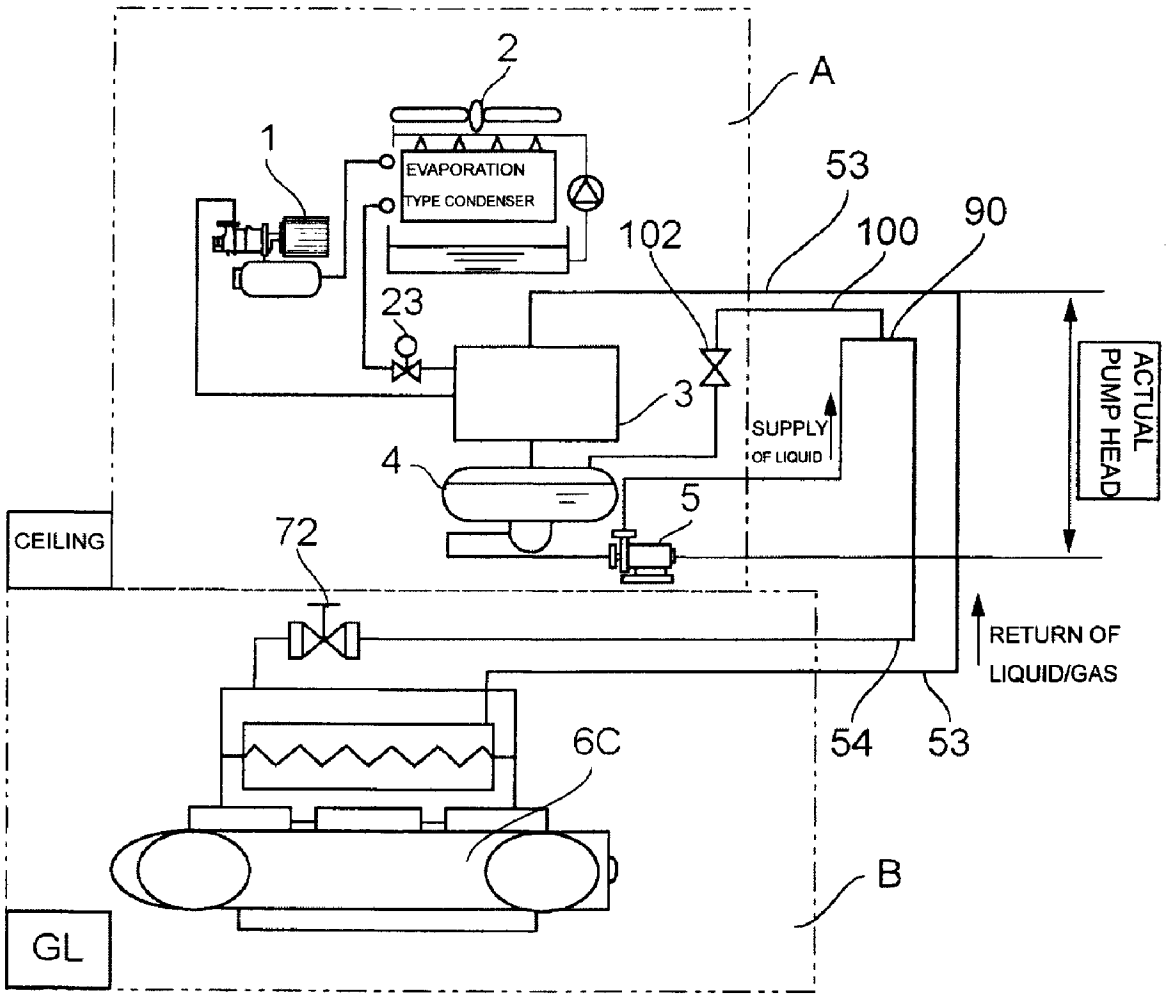
FIG. 9 is a schematic representation of the present invention applied to a freezer room.

FIG. 9. represents the fourth embodiment of the present invention. In this embodiment, the ($NH_3$) evaporation type condenser unit and the receiver unit of FIG. 12 are unitized as an outdoor unit A and located on the ceiling of a freezing store B containing a $CO_2$ brine type freezer (freezer type chiller) in a refrigerating factory. A brine pump 5 located in the outdoor unit A is connected to the air chiller 6C by means of a riser pipe 90. The top part of the riser pipe 90 runs along a height position higher than the brine cooler 3 mounting position and about the same height level with a return pipe 53 for returning $CO_2$ brine from the cooler 6C to the brine cooler 3.

The configuration of the embodiment is similar to that of other embodiments other than the above-mentioned point, but in this embodiment, the freezer type chiller 6B in the freezing store B is located at a position lower than the brine cooler in the outdoor unit A which is located on the ceiling of the of the freezer store B. Both the top part of the riser pipe 90 and return pipe 53 is located to run along a height position higher than the maximum liquid level of $CO_2$ in the liquid receiver 4, preferably higher than the brine cooler 3. In FIG. 14, ceiling and GL means respectively the level of the ceiling and the ground level.

EMBODIMENT EXAMPLE 5

Figure 10:
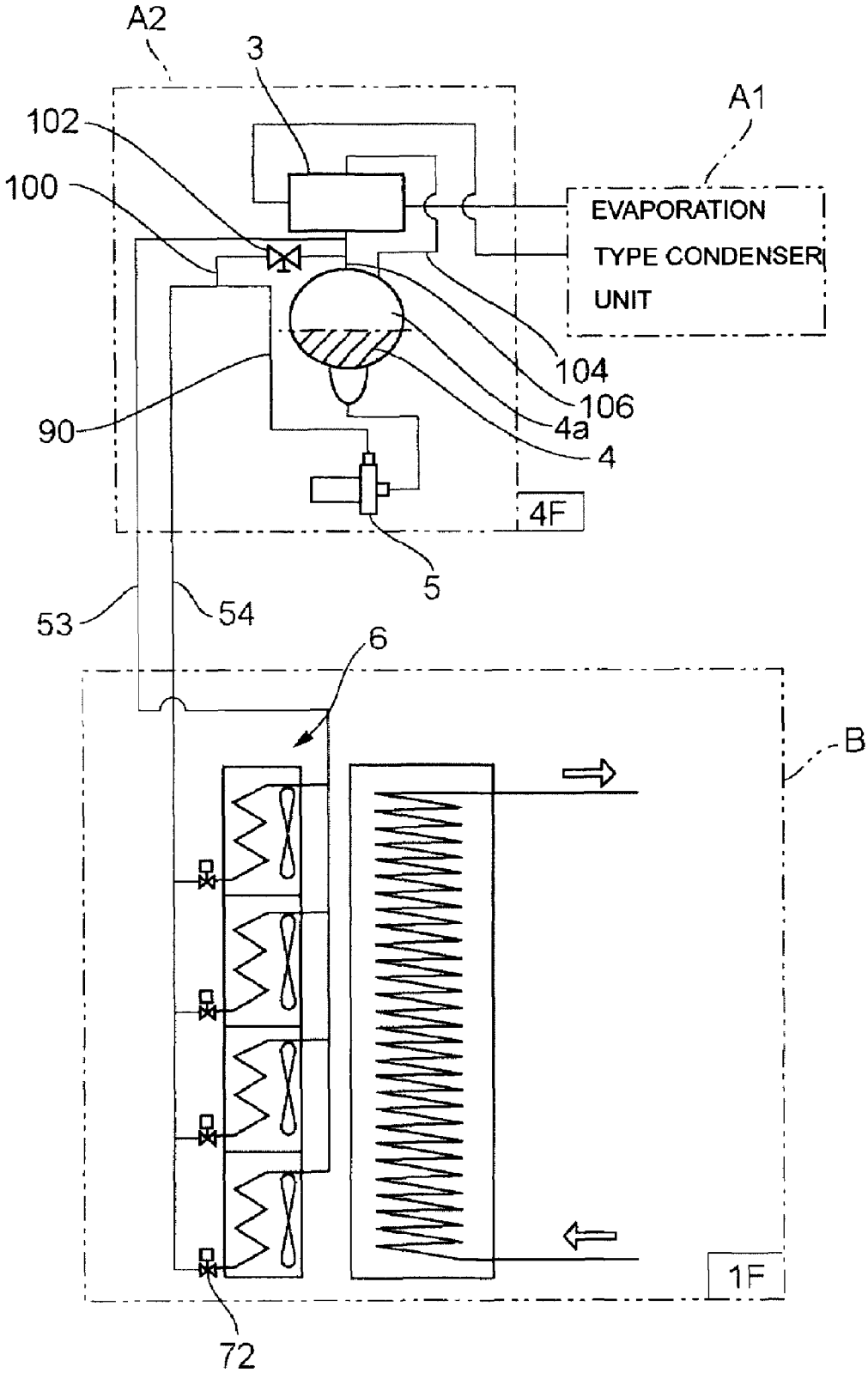
FIG. 10 is a schematic representation of the present invention applied to a refrigerating machine and when a return pipe is connected to the liquid receiver.
Figure 11A:
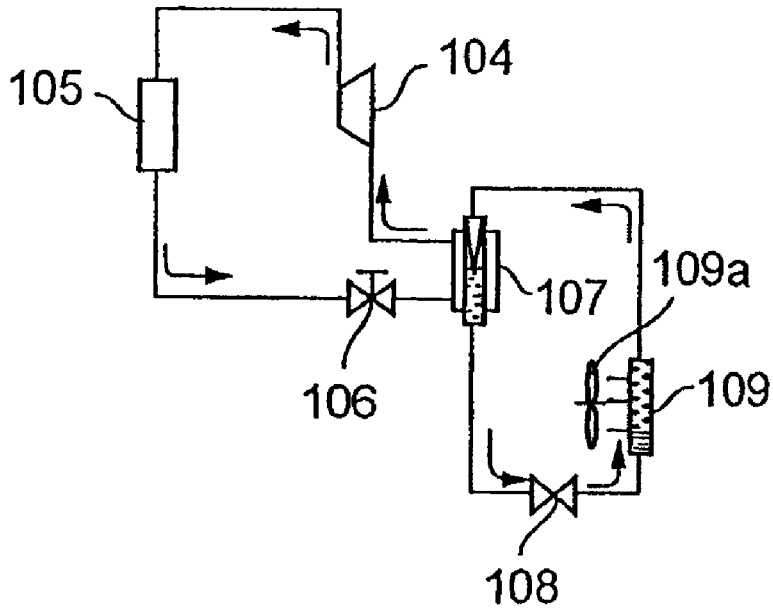
FIG. 11 is a schematic representation of an ammonia refrigerating unit of prior art provided with an evaporation type condenser.
Figure 11B:
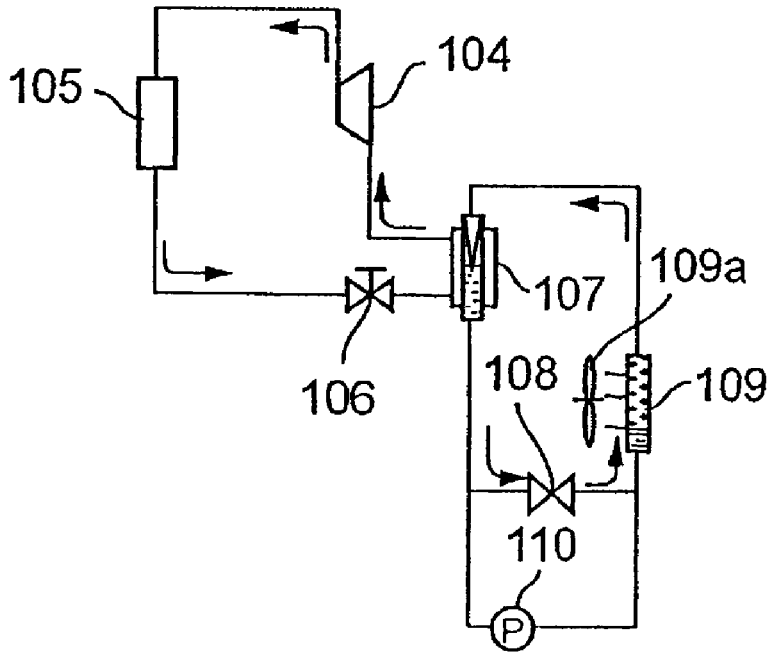

The example 5 shown in FIG. 10 is a case the cooler 6 is located in the first floor and an evaporation type condenser unit A1 and machine unit A2 are located in a machine room provided in the fourth floor.

In the example 5, the ($NH_3$) evaporation type condenser unit A1 comprises an ammonia compressor, an evaporator condenser, an expansion valve not sown in the drawing, and the brine cooler 3 is provided in the machine unit A2, thus an ammonia refrigerating cycle is composed.

The machine unit A2 is located adjacent the evaporation type condenser unit A1. The machine unit A2 comprises the liquid receiver 4 for receiving $CO_2$ cooled and liquefied in the brine cooler 3, the variable speed liquid pump 5, and the riser pipe 90. The top part of the riser pipe 90 is positioned in a height position higher than that of the liquid receiver 4. The top part is communicated to the $CO_2$ gas layer 4*a* in the liquid receiver 4 via the communication pipe 100, and the flow control valve 102 is attached to the communication pipe 100.

$CO_2$ brine liquid flows under discharge pressure of the liquid pump 5 located below the liquid receiver 4 through a liquid supply piping 54 and via each of valves 72 into each of coolers 6. A part of $CO_2$ brine liquid evaporates in the coolers 6, and $CO_2$ of gas/liquid mixed state returns to the liquid receiver 4 via a return pipe 53.

As to action of the riser pipe 90 and communication pipe 100 was already explained in example 1.

In this example 5, the brine cooler 3 is located at a height position higher than that of the liquid receiver 4, and $CO_2$ recovered from the outlets of the coolers 6 is returned to the $CO_2$ gas layer 4*a* in the liquid receiver 4 not to the brine cooler. The $CO_2$ gas layer 4*a* in the liquid receiver 4 is communicated to the brine cooler 3 via a pipe 104 so that condensed and liquefied $CO_2$ brine is stored in the liquid receiver 4.

As $CO_2$ recovered from the outlets of the coolers 6 is in a liquid or gas/liquid mixed state, flow resistance in the brine cooler 3 increases and the liquid pump 5 is excessively loaded due to increased discharge pressure. By returning the $CO_2$ of liquid or gas/liquid mixed state to the $CO_2$ gas layer 4*a* in the liquid receiver 4, back pressure (discharge pressure) of the liquid pump 5 can be reduced. Further, a condensing cycle can be carried out by communicating the $CO_2$ gas layer 4*a* in the liquid receiver 4 to brine cooler 3 via the piping 104 to condense and liquefy the $CO_2$ of the $CO_2$ gas layer 4*a* in the liquid receiver 4, and returning the liquefied $CO_2$ to the liquid receiver 4 via a pipe 106 to be stored in the liquid receiver 4, so condensation and liquefaction of $CO_2$ can be carried out also in a case of not returning the liquid $CO_2$ to the brine cooler 3.

INDUSTRIAL APPLICABILITY

As is described in the foregoing, according to the present invention, an ammonia refrigerating cycle, a brine cooler to cool and liquefy the $CO_2$ by utilizing the latent heat of vaporization of the ammonia, and a $CO_2$ brine producing apparatus having a liquid pump in the $CO_2$ supply line for supplying $CO_2$ to the refrigeration load side are unitized in a single unit, and the ammonia cycle and $CO_2$ brine cycle can be combined without problems even when refrigeration load such as refrigerating showcase, etc. is located in any place in accordance with circumstances of customer's convenience.

Further, according to the present invention, $CO_2$ circulation cycle can be formed irrespective of the position of the $CO_2$ cycle side cooler, kind thereof (bottom feed type of top feed type), and the number thereof, and further even when the brine cooler is located at a position lower than the refrigeration load side cooler.

What is claimed:

1. An ammonia/$CO_2$ refrigeration system comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side heat exchanger (cooler), wherein are provided;

a receiver for receiving $CO_2$ brine cooled in said brine cooler, a liquid pump composed to be a variable-discharge type forced circulating pump, which corresponds to said liquid pump for supplying the cooled and liquefied $CO_2$, a riser pipe located between said liquid pump and a heat exchanger of refrigeration load side, a communication pipe for connecting the top part of the riser pipe to the $CO_2$ gas layer in said liquid receiver;

wherein discharge pressure (of forced circulation) is determined so that $CO_2$ recovered from the outlet of cooler of refrigeration load side returns to said brine cooler or said liquid receiver in a liquid or gas/liquid mixed state (incompletely evaporated state), and wherein the top part of the riser pipe runs along a height position equal to or higher than the maximum liquid level of $CO_2$ reserved in the liquid receiver.

2. The ammonia/$CO_2$ refrigeration system according to claim 1, wherein the volume of the liquid receiver including the volume in the pipe connecting to the inlet of the liquid pump is determined so that there remains a room for $CO_2$ gas above liquid $CO_2$ recovered to the liquid receiver when the operation of $CO_2$ brine cycle is halted.

3. The ammonia/$CO_2$ refrigeration system according to claim 1, wherein a supercooler is provided for supercooling at least a part of the liquid $CO_2$ in the liquid receiver in order to maintain liquid $CO_2$ in a supercooled state at the inlet of the liquid pump.

4. The ammonia/$CO_2$ refrigeration system according to claim 3, wherein a pressure sensor and a temperature sensor for detecting the pressure and temperature of $CO_2$ in the liquid receiver, and a controller for determining the degree of supercooling by comparing the saturation temperature of $CO_2$ at the detected pressure with the detected temperature are further provided, and wherein flow of ammonia introduced to the supercooler is controlled by a signal from said controller.

5. The ammonia/$CO_2$ refrigeration system according to claim 1, wherein a pressure sensor is provided for detecting pressure difference between the outlet and inlet of the liquid pump, and wherein the liquid pump is composed so that it can achieve discharge head equal to or higher than the sum of actual head from the liquid pump to the top part of the riser pipe and loss of head in the piping.

6. The ammonia/$CO_2$ refrigeration system according to claim 3, wherein the liquid receiver receiving liquid $CO_2$ supercooled at any rate is located at a position higher than the suction side of the liquid pump.

7. The ammonia/$CO_2$ refrigeration system according to claim 1, wherein a flow control valve is provided to said communication pipe.

8. The ammonia/$CO_2$ refrigeration system according to claim 1, wherein said brine cooler is located at a height position higher than that of said liquid receiver, $CO_2$ of liquid or gas/liquid mixed state recovered from the outlet of said refrigeration load side cooler is returned to the $CO_2$ gas layer of said liquid receiver, and the $CO_2$ gas layer of said liquid receiver is communicated to said brine cooler so that $CO_2$ brine condensed and liquefied in said brine cooler is returned to said liquid receiver to be stored therein.

* * * * *